US006050279A

United States Patent [19]

Goad

[11] Patent Number: 6,050,279

[45] Date of Patent: Apr. 18, 2000

[54] APPARATUS AND METHOD FOR IMMERSING AN OBJECT IN A LIQUID SUCH THAT A LOWER SURFACE OF THE OBJECT DOES NOT TOUCH A BOTTOM SURFACE OF A CONTAINER HOLDING THE LIQUID

[75] Inventor: Allison L. Goad, Austin, Tex.

[73] Assignee: Advanced Micro Devices, Inc., Sunnyvale, Calif.

[21] Appl. No.: 09/093,544

[22] Filed: Jun. 8, 1998

[51] Int. Cl.[7] ..... B08B 3/04

[52] U.S. Cl. ..... 134/201; 134/135; 134/902

[58] Field of Search ..... 134/201, 133, 134/135, 137, 900, 902; 68/213; 396/654, 653, 652; 118/501, 503

[56] References Cited

U.S. PATENT DOCUMENTS

| | | | |
|---|---|---|---|
| 1,392,516 | 10/1921 | McKelvey et al. . | |
| 1,394,697 | 10/1921 | Tornsjo . | |
| 1,398,423 | 11/1921 | Dye . | |
| 1,415,189 | 5/1922 | Oxley . | |
| 1,451,066 | 4/1923 | Dye . | |
| 1,454,213 | 5/1923 | Chapman et al. . | |
| 1,687,581 | 10/1928 | Murphy . | |
| 1,825,310 | 9/1931 | Engstrom . | |
| 2,362,251 | 11/1944 | Eggleton | 15/105 |
| 2,915,954 | 12/1959 | Deal . | |
| 3,636,954 | 1/1972 | Weston . | |
| 4,200,949 | 5/1980 | Heniff, Jr. | 15/257.05 |
| 5,181,604 | 1/1993 | Ohta et al. | 206/5.1 |

*Primary Examiner*—Frankie L. Stinson
*Attorney, Agent, or Firm*—Kevin L. Daffer; Conley, Rose & Tayon

[57] ABSTRACT

An apparatus and method are presented for immersing an object in a liquid such that a lower surface of the object does not touch a bottom surface of a container. The apparatus includes a forceps for holding the object and a pin for limiting movement of the forceps in relation to the container. The forceps includes a pair of jaws having opposed surfaces used to grip the object. A hole dimensioned to receive the pin extends through the pair of oppose surfaces. The container is used to hold the liquid, and has an opening in an upper portion surrounded by a lip. The object is gripped between the opposed surfaces of the jaws, and the pin is inserted through the hole in the forceps. The forceps is positioned above the container, then lowered until the object enters the liquid and the pin contacts the lip of the container. The pin limits vertical downward movement of the forceps with respect to the container, preventing the lower surface of the object from touching the bottom surface of the container. In one embodiment, the pin is substantially cylindrical and has a substantially circular cross section. In an alternate embodiment, the pin is substantially "T"-shaped and has a substantially rectangular cross section. The alternate embodiment provides additional stability for the forceps, allowing the forceps to remain upright when released by a user after the pin contacts the lip of the container.

18 Claims, 6 Drawing Sheets

APPARATUS AND METHOD FOR IMMERSING AN OBJECT IN A LIQUID SUCH THAT A LOWER SURFACE OF THE OBJECT DOES NOT TOUCH A BOTTOM SURFACE OF A CONTAINER HOLDING THE LIQUID

BACKGROUND OF THE INVENTION

1. Field of the Invention

This invention relates to apparatus and methods for immersing an object in a liquid.

2. Description of Related Art

A wafer fabrication process typically forms many identical integrated circuits upon each of several silicon wafers processed as a group (i.e., lot). Each integrated circuit is formed within a designated area of a wafer, and includes electronic devices electrically coupled by conductive traces called interconnect lines (i.e., interconnects). Interconnects are typically patterned from conductive layers formed on or above the surface of a silicon substrate. One or more conductive layers may be patterned to form one or more levels of interconnects vertically spaced from each other by one or more interlevel dielectric layers. Dielectric-spaced interconnect levels allow formations of densely patterned devices on relatively small surface areas. Interconnects on different levels are connected using contact structures formed in openings in the interlevel dielectric layers (i.e., vias). Following wafer fabrication, the individual integrated circuit dice are separated from the wafers, and each functional die is typically secured within a protective semiconductor device package.

The wafer fabrication process requires a high degree of precision, and it is important to identify and solve process problems as quickly as possible. Throughout the process a variety of tests and measurements are made to judge wafer and process quality. Allowing resolution down to submicometer levels, a scanning electron microscope (SEM) is useful in forming an image of integrated circuit structures. In a SEM, the source of illumination is an electron beam scanned over a surface. The incident (i.e., "primary") electrons cause bombarded materials on and just under the surface to eject "secondary" electrons. The energy levels (wavelengths) of ejected secondary electrons are detected and used to form an image of the surface, either on a viewing screen or as a photograph.

The SEM technique may be used to determine the dimensions of integrated circuit structures (e.g., thicknesses of interconnects) and to assess the integrity of contact structures. The integrated circuit may be scribed directly above the structure of interest and broken along the scribe line in order to reveal the structure of interest. The surface along the break may then be polished in a lapping process using successively finer grades of abrasive in preparation for SEM analysis.

When interconnects and contact structures are to be studied using the SEM technique, the integrated circuit may be immersed briefly (i.e., "dipped") in a mixture of hydrofluoric acid (HF) and water ($H_2O$) following polishing. The liquid HF—$H_2O$ mixture removes silicon dioxide ($SiO_2$) interlevel dielectric material surrounding the interconnects and contact structures, thereby forming a surface topography which highlights the interconnects and contact structures for subsequent SEM analysis.

FIG. 1 is a front elevation view of an apparatus 10 used for dipping an integrated circuit die 12 in a liquid HF—$H_2O$ mixture 14. Integrated circuit die 12 includes a polished lower surface 16 being prepared for SEM analysis. Apparatus 10 includes a forceps 18 and a container 20. Forceps 18 are used to grip an upper portion of die 12 opposite lower surface 16 during the dipping operation in order to prevent damage to surface 16. Forceps 18 may be a compound lever forceps as shown in FIG. 1, and may be formed in one piece by injection molding. (See, for example, U.S. Pat. No. 3,636,954).

Container 20 is used to hold liquid HF—$H_2O$ mixture 14. Integrated circuit die 12 is positioned between opposed jaws of forceps 18 such that lower surface 16 faces downward. Forceps 18 are positioned above container 20, and lowered until die 20 is 30 immersed in liquid HF—$H_2O$ mixture 14. After a short period of time (e.g., a number of seconds), forceps 18 are raised such that die 12 is removed from liquid HF—$H_2O$ mixture 14. Die 12 may then be rinsed in deionized water.

A problem arises when using apparatus 10. HF acid is highly corrosive, and the dipping procedure must be performed under a chemical vent hood. The dipping operation is performed manually, and a user must wear acid resistant protective equipment (i.e., gloves, apron, and safety glasses). Working under the vent hood forces the user to work with arms outstretched away from the body. The combined effects of gloved hands and outstretched arms makes it difficult to position forceps 18 such that die 12 remains immersed and lower surface 16 does not touch the bottom of container 20. Allowing lower surface 16 to touch the bottom of container 20 may damage the delicate interconnects or contact structures forming portions of lower surface 16 and no longer supported by surrounding interlevel dielectric material. When this happens, the damaged die 12 must be discarded. The steps of scribing, breaking along the scribe line to form surface 16, and polishing of the resultant surface 16 must be repeated upon another die 12.

It would thus be desirable to have an apparatus for immersing an object (e.g., an integrated circuit die) in a liquid (e.g., a liquid HF—$H_2O$ mixture) wherein the apparatus includes a means of ensuring a lower surface of the object does not touch the bottom of the container holding the liquid. Such an apparatus would prevent damage to the lower surface of the object during the immersing.

SUMMARY OF THE INVENTION

The problems outlined above are in large part solved by an apparatus and method for immersing an object in a liquid such that a lower surface of the object does not touch a bottom surface of a container holding the liquid. The apparatus includes a forceps for holding the object and a pin for limiting movement of the forceps in relation to the container.

The forceps includes a pair of jaws having opposed and substantially planar surfaces and ends protruding outwardly from the forceps. The forceps is used to grip the object between the opposed surfaces. A hole dimensioned to receive the pin extends through the pair of opposed surfaces and is located a spaced distance from the ends of the jaws. The hole has an axis substantially perpendicular to the opposed surfaces. The container is used to hold the liquid, and has an opening in an upper portion surrounded by a lip.

During use of the apparatus, the object is gripped between the opposed surfaces of the jaws, and the pin is inserted through the hole in the forceps such that a first portion of the pin extends from one side of the forceps and a second portion of the pin extends from an opposite side of the forceps. The pin has a dimension (e.g., a length) greater than a dimension (e.g., a diameter) of the opening of the container. The forceps is positioned above the container such that the object projects downwardly from the forceps. The forceps is then lowered until the object enters the liquid and the first and second portions of the pin contact the lip of the container. The pin limits vertical downward movement of the forceps with respect to the container, preventing the lower surface of the object from touching the bottom surface of the container.

In one embodiment, the pin is substantially cylindrical and has a substantially circular cross section. In an alternate embodiment, the pin is substantially "T"-shaped and has a substantially rectangular cross section. The alternate embodiment provides additional stability for the forceps, allowing the forceps to remain upright when released by a user after the pin contacts the lip of the container.

The hole in the forceps may be a spaced distance d from the ends, and the object may project a length l from the ends when gripped between the jaws. The container may have a height h from an upper surface of the lip to the bottom surface the container. In this case, height h is preferably greater than the sum of d and l such that the bottom surface of the object does not touch the bottom surface of the container when the pin contacts the lip of the container.

BRIEF DESCRIPTION OF THE DRAWINGS

Other objects and advantages of the invention will become apparent upon reading the following detailed description and upon reference to the accompanying drawings in which.

Figure 1:
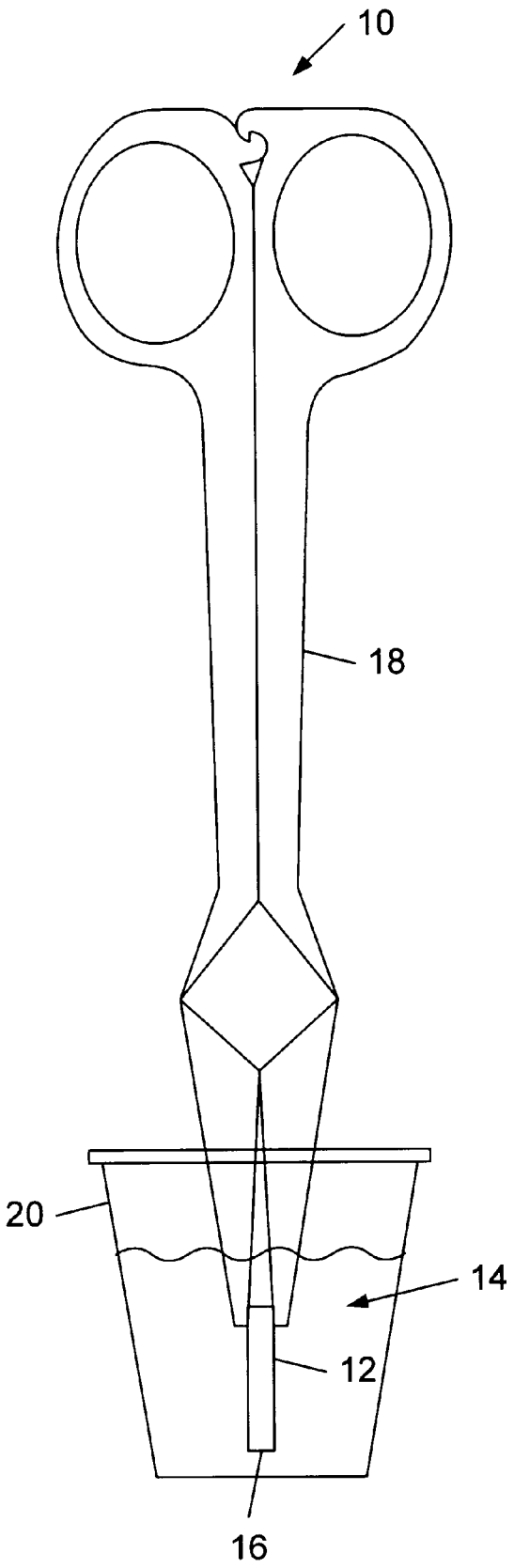
FIG. 1 is a front elevation view of an apparatus used for dipping an integrated circuit die in a liquid HF—$H_2O$ mixture.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figure 2:
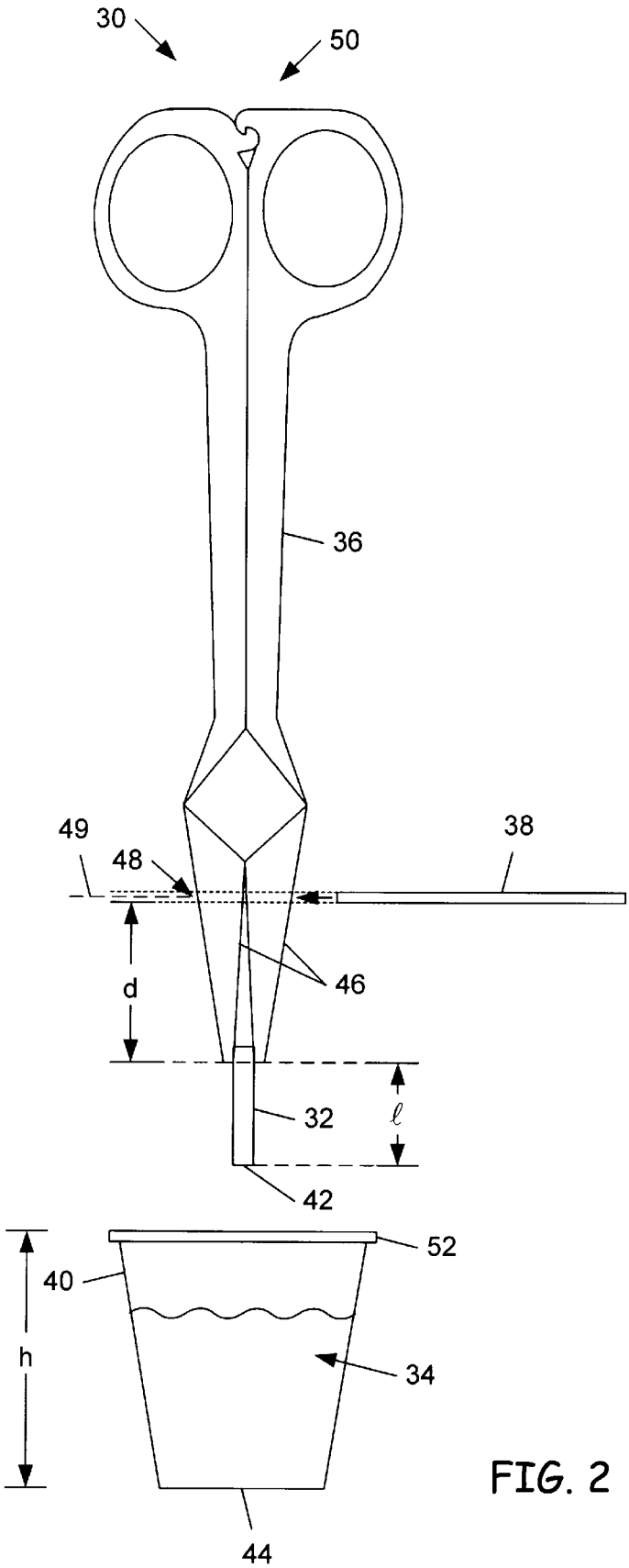
FIG. 2 is a front elevation view of one embodiment of an apparatus for immersing an object in a liquid according to the present invention, wherein the apparatus includes a container for holding the liquid, a forceps for gripping the object, and a pin for limiting movement of the forceps in relation to the container.

FIG. 2 is a front elevation view of one embodiment of an apparatus 30 for immersing (i.e., dipping) an object 32 in a liquid 34 according to the present invention. Apparatus 30 includes a forceps 36, a pin 38, and may include a container 40. Object 32 may have a lower surface 42 which preferably does not touch a bottom surface 44 of container 40. For example, object 32 may be an integrated circuit die including a polished lower surface 42 being prepared for SEM analysis, and liquid 34 may be an HF—$H_2O$ mixture. Forceps 36 are used to grip an upper portion of object 32 opposite lower surface 42.

In FIG. 2, forceps 36 includes a pair of jaws 46 connected to a pair of handles by a compound lever mechanism, wherein jaws 46 are operated by moving the handles in relation to one another. Jaws 46 have opposed and substantially planar inner surfaces. Moving the handles toward one another brings the opposed surfaces of jaws 46 together. Jaws 46 are used to grip object 32 during the dipping operation. Forceps 36 may be a single piece construction formed from a flexible and fatigue-resistant plastic material (e.g. polypropylene).

A hole 48 extends through the opposed surfaces of jaws 46, and has an axis 49 substantially perpendicular to the opposed surfaces. Hole 48 is dimensioned to receive pin 38. Forceps 36 may also include a locking mechanism 50. Locking mechanism 50 may include a pair of cooperating interlockable hooklike members on inner surfaces of the handles opposite jaws 46 as shown in FIG. 2.

Container 40 is used to hold liquid 34 during the dipping operation. Container 40 has an opening in an upper portion opposite bottom surface 44 and surrounded by a lip 52. During use of apparatus 30, object 32 is gripped between the opposed surfaces of jaws 46, and pin 38 is inserted through hole 48 in forceps 36. Forceps 36 is positioned above the opening of container 40 such that object 32 projects downwardly from forceps 36. Forceps 36 are then lowered until object 32 enters liquid 34 and pin 38 contacts lip 52, limiting further downward vertical movement of forceps 36 relative to container 40. Such limited vertical movement prevents lower surface 42 of object 32 from touching bottom surface 44 of container 40 during the dipping operation.

Jaws 46 have ends protruding outwardly from forceps 36, and object 32 is preferably gripped between the ends of jaws 46 as shown in FIG. 2. Hole 48 is preferably a spaced distance d from the ends of jaws 46. When gripped between jaws 46, object 32 projects a length l from the ends of jaws 46. Container 40 has a height h from an upper surface of lip 52 to bottom surface 44. Height h is preferably greater than the sum of d and l such that lower surface 42 of object 32 does not touch bottom surface 44 of container 40 when object 32 is immersed in liquid 34 and pin 38 contacts lip 52.

Figures 3A, 3B:
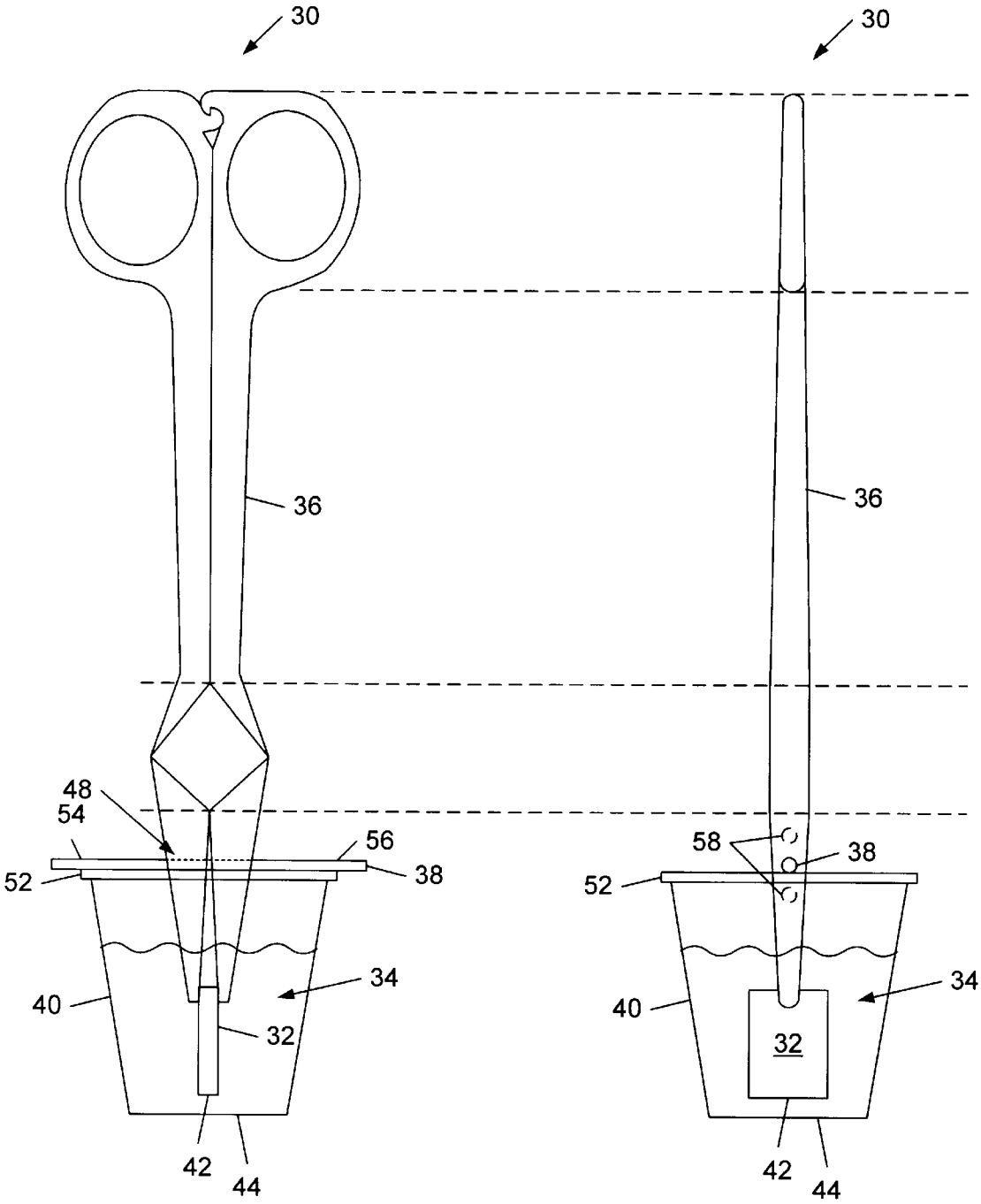
FIG. 3*a* is a front elevation view of the embodiment of the apparatus of FIG. 2 showing the object immersed in the liquid, wherein the pin is inserted through a hole in the forceps and contacts a lip surrounding an opening in an upper portion of the container such that vertical downward movement of the forceps with respect to the container is limited.
FIG. 3*b* is a side elevation view of the embodiment of the apparatus of FIG. 2 showing the object immersed in the liquid.

FIG. 3*a* is a front elevation view of the embodiment of apparatus 30 of FIG. 2 showing object 32 immersed in liquid 34. Pin 38 is inserted through hole 48 in forceps 36 such that a first portion 54 of pin 38 extends from one side of forceps 36 and a second portion 56 of pin 38 extends from an opposite side of forceps 36. During immersion, first portion 54 and second portion 56 of pin 38 contact lip 52 of container 40 such that vertical downward movement of forceps 36 with respect to container 40 is limited. As described above, such limited vertical movement prevents lower surface 42 of object 32 from touching bottom surface 44 of container 40 during the dipping operation.

FIG. 3*b* is a side elevation view of the embodiment of apparatus 30 of FIG. 2 showing object 32 immersed in liquid 34. Pin 38 extends through hole 48 in forceps 36 and contacts lip 52 of container 40 during use as described above. As shown in FIG. 3*b*, forceps 36 may also have additional holes 58 extending through jaws 46 and dimensioned to receive pin 38. Thus a series of holes similar to hole 48 may exist along jaws 46 at varying distances d from the ends of jaws 46.

Pin 38 is preferably sufficiently rigid that it does not bend under the weight of forceps 36. Pin 38 has a dimension (e.g., a length) greater than a dimension (e.g., a diameter) of the opening in container 40 such that pin 38 contacts lip 52 as object 32 is lowered into liquid 34. In the embodiment of FIGS. 2 and 3*a–b,* pin 38 is preferably cylindrical and has a substantially circular cross section. Pin 38 may also be a rod having various cross sectional shapes, including triangular, rectangular, etc. Pin 38 may be made from, for example, a metal (e.g., stainless steel) or a plastic (e.g., polypropylene).

Figure 4:
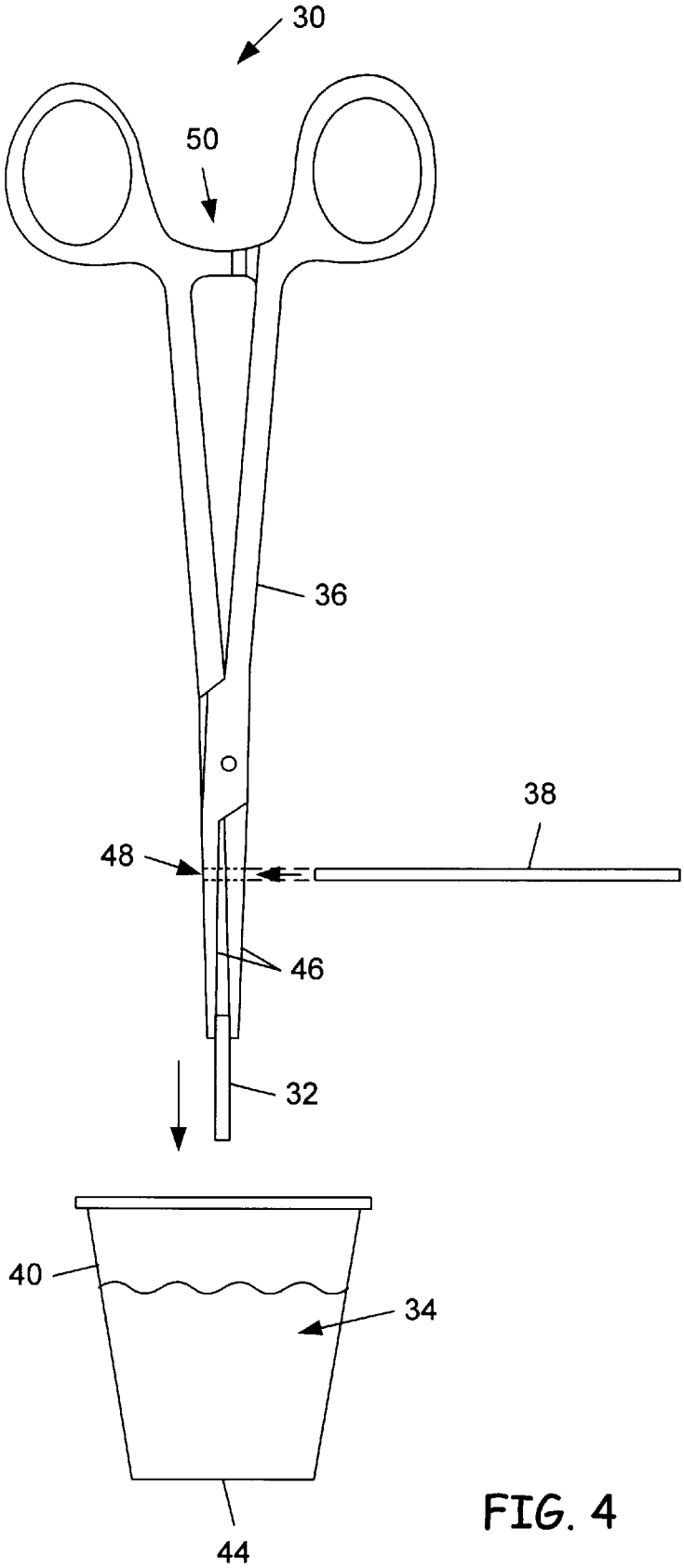
FIG. 4 is a front elevation view of the embodiment of the apparatus of FIG. 2 wherein the forceps includes two elongated members pivotally connected at a medial location.
Figure 5:
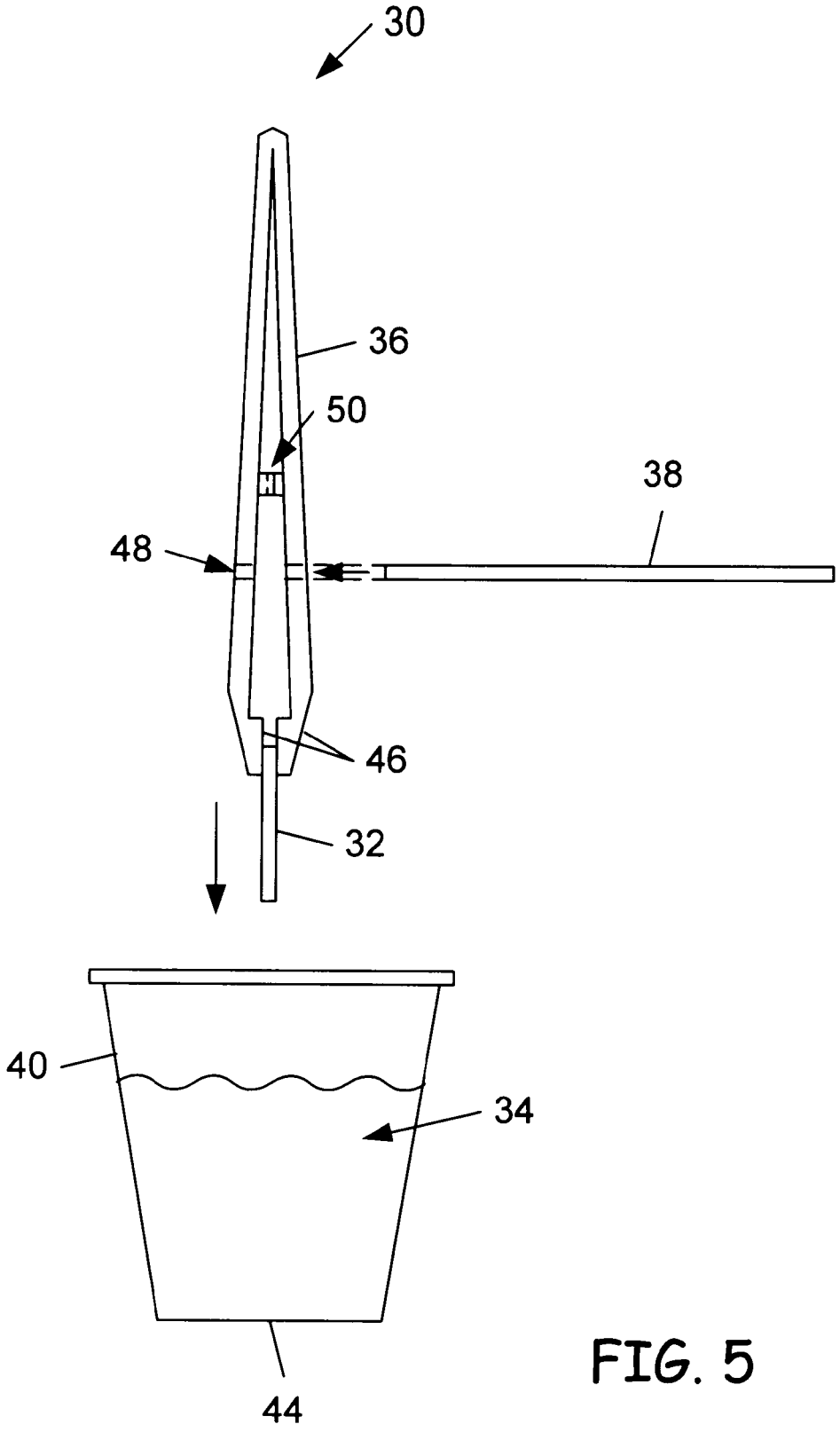
FIG. 5 is a front elevation view of the embodiment of the apparatus of FIG. 2 wherein the forceps includes two elongated members pivotally connected at one end.

FIGS. 4 and 5 are front elevation views of the embodiment of apparatus 30 of FIG. 2 illustrating different embodiments of forceps 36. In FIG. 4, forceps 36 includes two elongated members pivotally connected at a medial location forming a pair of jaws 46 at one end and a pair of handles at an opposite end, wherein the jaws are operated by relative movement of the handles. In FIG. 5, forceps 36 includes two elongated members pivotally connected at one end and having a pair of jaws 46 at an opposite end, wherein the jaws are operated by relative movement of the members. In the embodiments of FIGS. 4 and 5, forceps 36 and pin 38 may be made of, for example, a metal (e.g., stainless steel) or a plastic (e.g., polypropylene).

Figure 6:
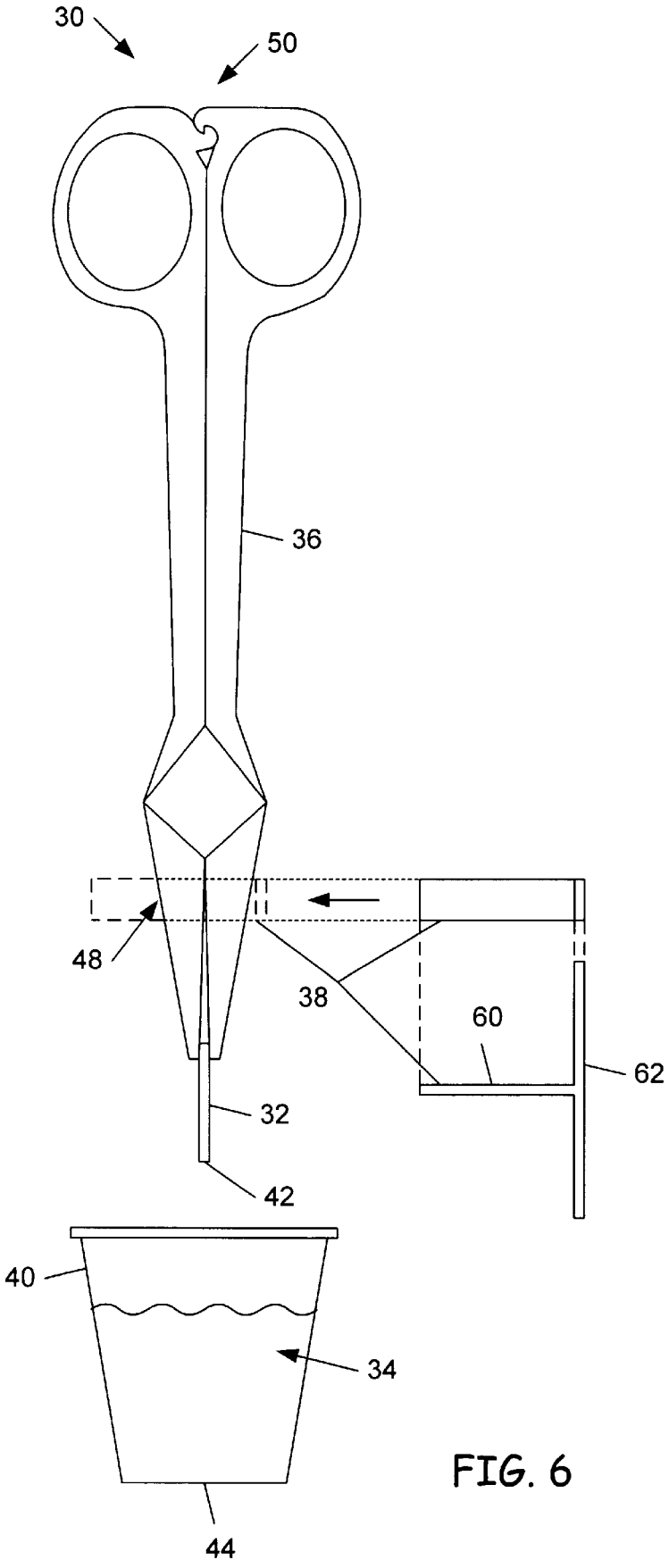
FIG. 6 is a front elevation view of an alternate embodiment of the apparatus for immersing the object in the liquid wherein the pin is "T"-shaped and provides additional stability for the forceps, allowing the forceps to remain upright when released by a user after the pin contacts the lip of the container.

FIG. 6 is a front elevation view of an alternate embodiment of apparatus 30 for immersing (i.e., dipping) an object 32 in a liquid 34. In the embodiment of FIG. 6, pin 38 is "T"-shaped and includes a main member 60 connected to a cross member 62. Pin 38 in FIG. 6 provides additional stability for forceps 36, allowing forceps 36 to remain upright when released by the user after pin 38 contacts lip 52 of container 40.

Main member 60 and cross member 62 may be coplanar as shown in FIG. 6. Main member 60 preferably has a cross-sectional shape which prevents forceps 36 from rotating about main member 60 when released (e.g. rectangular, triangular, etc.). The cross-sectional shape of cross member 62 may be circular, triangular, rectangular, etc. Main member 60 is preferably attached to cross member 62 substantially in the center of cross member 62, and main member 60 is preferably substantially perpendicular to cross member 62. Hole 48 in forceps 36 is dimensioned to receive main member 60 of pin 38.

During use of apparatus 30, main member 60 of pin 38 is inserted through hole 48 in forceps 36 such that main member 60 extends from one side of forceps 36 and cross member 62 extends from an opposite side of forceps 36. During immersion, an end of main member 60 opposite cross member 62 contacts lip 52 of container 40. Cross member 62 has a length greater than a dimension (e.g., a diameter) of the opening in container 40 such that opposite ends of cross member 62 also contact lip 52 as object 32 is lowered into liquid 34. By contacting lip 52 of container 40 at three points widely dispersed about forceps 36, pin 38 limits downward vertical downward movement of forceps 36 with respect to container 40 and provides stable support of forceps 36. As described above, such limited vertical movement prevents lower surface 42 of object 32 from touching bottom surface 44 of container 40 during the dipping operation, and such stable support allows forceps 36 to remain upright when released by the user after pin 38 contacts lip 52 of container 40.

It will be appreciated by those skilled in the art having the benefit of this disclosure that this invention is believed to be an apparatus and method for immersing an object in a liquid such that a lower surface of the object does no touch a bottom surface of a container holding the liquid. It is intended that the following claims be interpreted to embrace all such modifications and changes and, accordingly, the specification and drawings are to be regarded in an illustrative rather than a restrictive sense.

What is claimed is:

1. An apparatus for securing an object, comprising:

forceps having a pair of opposed surfaces and locking means for fixing the relative positions of the opposed surfaces, wherein the forceps is configured to grip the object between the opposed surfaces; and a pin adapted to: (i) extend through a hole formed through the forceps, and (ii) contact a lip surrounding an opening in an upper portion of a container at three points widely dispersed about the lip when the opposed surfaces of the forceps are inserted into the opening.

2. The apparatus as recited in claim 1, wherein the pin comprises:

a main member adapted to extend through the hole formed through the forceps and to contact the lip at one of the three points; and a cross member connected to the main member and adapted to contact the lip at two of the three points.

3. The apparatus as recited in claim 2, wherein an inner surface of the hole is dimensioned to frictionally receive the main member of the pin.

4. The apparatus as recited in claim 2, wherein the cross member extends along an axis which is longer than the opening in the container.

5. The apparatus as recited in claim 2, wherein during use the main member of the pin is inserted through the hole such that a portion of the main member extends from one side of the forceps and the cross member extends from an opposite side of the forceps.

6. The apparatus as recited in claim 5, wherein during use the main and cross members of the pin contact the lip of the container such that vertical downward movement of the forceps with respect to the container is limited.

7. The apparatus as recited in claim 6, wherein the pair of opposed surfaces have ends protruding outwardly from the forceps, and wherein the object is gripped between the ends, and wherein the hole is a spaced distance d from the ends, and wherein the object projects a length l from the ends, and wherein the container has a height h from an upper surface of the lip to a bottom surface of the container, and wherein $h>(d+l)$ such that a bottom surface of the object does not touch the bottom surface of the container when the main and cross members of the pin contact the lip of the container.

8. The apparatus as recited in claim 2, wherein the main member has a substantially polygonal cross section.

9. The apparatus as recited in claim 2, wherein the pin is substantially "T"-shaped, and wherein the main member of the pin has a substantially rectangular cross section.

10. The apparatus as recited in claim 1, further comprising the container, and wherein the container is adapted to contain a liquid into which the opposed surfaces of the forceps can be inserted.

11. The apparatus as recited in claim 1, wherein the hole in the forceps has an axis substantially perpendicular to the opposed surfaces.

12. The apparatus as recited in claim 1, wherein the locking means comprises a pair of cooperating interlockable hooklike members.

13. An apparatus for immersing an object in a liquid, comprising:

forceps having a pair of jaws and locking means for fixing the relative positions of the jaws, wherein the jaws have opposed and substantially planar surfaces, wherein the forceps is configured to grip the object between the opposed surfaces, and wherein a hole extends through the forceps and has an axis substantially perpendicular to the opposed surfaces;

a container for containing the liquid, wherein the container has an opening in an upper portion, and wherein the opening is surrounded by a lip;

a pin for limiting movement of the forceps in relationship to the container, wherein the pin is adapted to extend through the hole in the forceps and to contact the lip at three points widely dispersed about the lip when the jaws of the forceps are inserted into the opening, and wherein the pin comprises a main member and a cross member connected to the main member;

wherein during use:

the main member is inserted through the hole in the forceps such that a portion of the main member extends from one side of the forceps and the cross member extends from an opposite side of the forceps; and the main member contacts the lip of the container at one of the three points and the cross member contacts the lip at two of the three points when the jaws of the forceps are inserted into the opening of the container such that vertical downward movement of the forceps with respect to the container is limited.

14. The apparatus as recited in claim 13, wherein the hole in the forceps is dimensioned to receive the main member of the pin.

15. The apparatus as recited in claim 13, wherein the main member has a substantially polygonal cross section.

16. The apparatus as recited in claim 13, wherein the pin is substantially "T"-shaped, and wherein the main member has a substantially rectangular cross section.

17. The apparatus as recited in claim 13, wherein the jaws have ends protruding outwardly from the forceps, and wherein the object is gripped between the ends, and wherein the hole is a spaced distance d from the ends, and wherein the object projects a length l from the ends, and wherein the container has a height h from an upper surface of the lip to a bottom surface the container, and wherein $h>(d+l)$ such that a bottom surface of the object does not touch the bottom surface of the container when the main and cross members of the pin contact the lip of the container.

18. The apparatus as recited in claim 13, wherein the locking means comprises a pair of cooperating interlockable hooklike members.

* * * * *